United States Patent [19]

Chaiko

[11] Patent Number: 4,490,074

[45] Date of Patent: Dec. 25, 1984

[54] FRICTION ROCK STABILIZER AND SHEATHING MEANS, IN COMBINATION, AND METHOD OF SECURING A FRICTION ROCK STABILIZER IN AN EARTH BORE

[75] Inventor: Walter M. Chaiko, Titusville, N.J.

[73] Assignee: Ingersoll-Rand Company, Woodcliff Lake, N.J.

[21] Appl. No.: 502,347

[22] Filed: Jun. 10, 1983

Related U.S. Application Data

[63] Continuation-in-part of Ser. No. 224,373, Jan. 12, 1982, abandoned.

[51] Int. Cl.[3] ..... E21D 20/00

[52] U.S. Cl. ..... 405/259; 405/261

[58] Field of Search ..... 405/259, 260, 261, 262; 411/15, 60, 446, 447, 451, 456, 900-903

[56] References Cited

U.S. PATENT DOCUMENTS

| | | | |
|---|---|---|---|
| 1,330,906 | 2/1920 | Schoenfeld | 411/456 |
| 2,696,137 | 12/1954 | Thomas et al. | 405/259 X |
| 3,641,772 | 2/1972 | Dietrich | 405/260 |
| 3,813,985 | 6/1974 | Perkins | 411/902 X |
| 4,022,101 | 5/1977 | Helgesson | 411/60 |
| 4,051,681 | 10/1977 | Yaros | 405/261 |
| 4,132,080 | 1/1979 | Hansen | 405/261 |

FOREIGN PATENT DOCUMENTS

| | | | |
|---|---|---|---|
| 609642 | 2/1935 | Fed. Rep. of Germany | 411/15 |
| 2748919 | 5/1979 | Fed. Rep. of Germany | 405/259 |
| 1525224 | 4/1968 | France | 405/259 |
| 78/5306 | 9/1978 | South Africa | 405/259 |

*Primary Examiner*—David H. Corbin
*Attorney, Agent, or Firm*—B. J. Murphy

[57] ABSTRACT

Broadly, the structures of the invention comprises a friction rock stabilizer and a sheath therefor to isolate the stabilizer from the surface of an earth structure bore and its associated corrosion environment, and bonding between the engaging surfaces of the stabilizer and sheath. The sheath, of low-friction polyethylene (although other suitable material could be used), facilitates stabilizer insertion into the bore. Additionally, the polyethylene sheath is heat and pressure sensitive. Insertion of the stabilizer generates considerable frictional heat and pressure and, as a consequence, upon the stabilizer being fully inserted, the sheath fuses onto the exterior, interfacing surface of the stabilizer. Further, the sheath material extrudes from prominences and flows into crevices (a) in the surface of the bore against which it is forceably pressed, and (b) plastically deforms to insinuate itself into, around, and onto discontinuities in the interfacing surface of the stabilizer, lockingly to engage with the latter surface. Such fusing, extrusion and flow, and the aforesaid locking engagement inhibit disengagement of the stabilizer from the sheath, and the sheath from the bore, following insertion of the stabilizer into a sheath-lined bore. The method of the invention comprises preparing one of the aforesaid engaging surfaces with adhesive, or grit, etc., to secure the stabilizer, in the bore, firmly bonded to the sheath.

19 Claims, 12 Drawing Figures

36b
40
10
12
12
14
12
16

10c
12b
20
22

10a
12a
18
14a
12a
12a 10b
18a 10d
12c
20a
22a 16
36

36a
38
28
24
26

34
26a 44
42
48
46
44
42
48

52
50
36d
52
32
30
18b
16
10e

FRICTION ROCK STABILIZER AND SHEATHING MEANS, IN COMBINATION, AND METHOD OF SECURING A FRICTION ROCK STABILIZER IN AN EARTH BORE

This application is a continuation-in-part of application Ser. No. 224,373, filed 01/12/82, now abandoned.

The invention pertains, generally, to friction rock stabilizers, such as are disclosed in U.S. Pat. No. Re 30,256, issued on Apr. 8, 1980, to James J. Scott (for "Friction Rock Stabilizers"). More particularly, it pertains to methods of securing friction rock stabilizers in earth bores, and to a combination friction rock stabilizer and corrosion isolating sheath therefor with means to inhibit separation of said stabilizer and sheath, or to means for bonding said stabilizer and sheath together.

The invention comprises improvements for the "Friction Rock Stabilizer and a Method of Isolating the Same from a Bore Surface", of U.S. patent application Ser. No. 159,184, filed on June 13, 1980, by myself and co-inventor John A. Larson. As noted in the aforesaid patent application, there are many applications where it is necessary to protect the surface of a friction rock stabilizer from water, chemicals, and the like, which obtain in many mine environments, and which would cause the general degradation of the stabilizer in a relatively short period of time. Also, typically the surface of an earth structure bore is irregular and coarse and, as a consequence, frictionally resists entry therein by the stabilizer. By shielding or isolating the stabilizer from the bore surface, and presenting a smooth, low friction surface to the stabilizer, the aforesaid frictional resistance can be markedly reduced.

Research and development efforts are being pursued to provide a corrosion-resistant friction rock stabilizer in which the stabilizer is inserted into a plastic sleeve which has been previously inserted in an earth structure bore. This practice has the benefit of accommodating a low thrust insertion. However, there is a need to bond the sleeve plastic to the metal stabilizer after insertion thus bringing the stabilizer anchorage up to acceptable levels.

The aforesaid research and development efforts proceed from the teachings set out in the cited, co-pending patent application Ser. No. 159,184; 6/13/1980). The instant invention concerns methods and structures inventively designed to meet the sleeve-to-stabilizer bonding.

It is an object of this invention, then, to set forth, in combination, a friction rock stabilizer, for stabilizing an earth structure, and sheathing means therefor, wherein said stabilizer comprises an elongate element for resisting movement of an earth structure from within a bore formed, to receive said element therewithin, in the earth structure, and includes first means for exerting an outwardly-directed, radial, earth-stabilizing force against the surface of such an earth structure bore; said sheathing means has given surfacing, on opposite sides thereof, of given surface conformations; and said exterior surface of said element comprises second means for cooperating with said first means for altering at least one of said surface conformations, of said sheathing means, to cause said sheathing means lockingly to engage at least one of said bore and element surfaces.

It is also an object of this invention to teach a method of securing a friction rock stabilizer in a closed-end earth structure bore, comprising the steps of providing plastic, sheath-material sheathing which has given surfacing, on opposite sides thereof, of given surface conformations; interposing a lining of such sheathing between the surface of at least a portion of the bore and the exterior surface of the stabilizer; treating the exterior surface of the stabilizer to cause such exterior surface to alter at least one of said surface conformations, to cause the sheathing means lockingly to engage at least one of the bore and stabilizer surfaces, upon the exterior surface of the stabilizer exerting an outwardly-directed, radial force against the lining and the bore; and manipulating the stabilizer to cause it to exert an outwardly-directed, radial force against the lining and the bore.

Further objects of this invention, as well as the novel features thereof, will become more apparent by reference to the following description, taken in conjunction with the accompanying figures, in which.

Figures 1, 2, 3, 4A, 4B, 5, 6, 7, 8, 9, 10, 11:
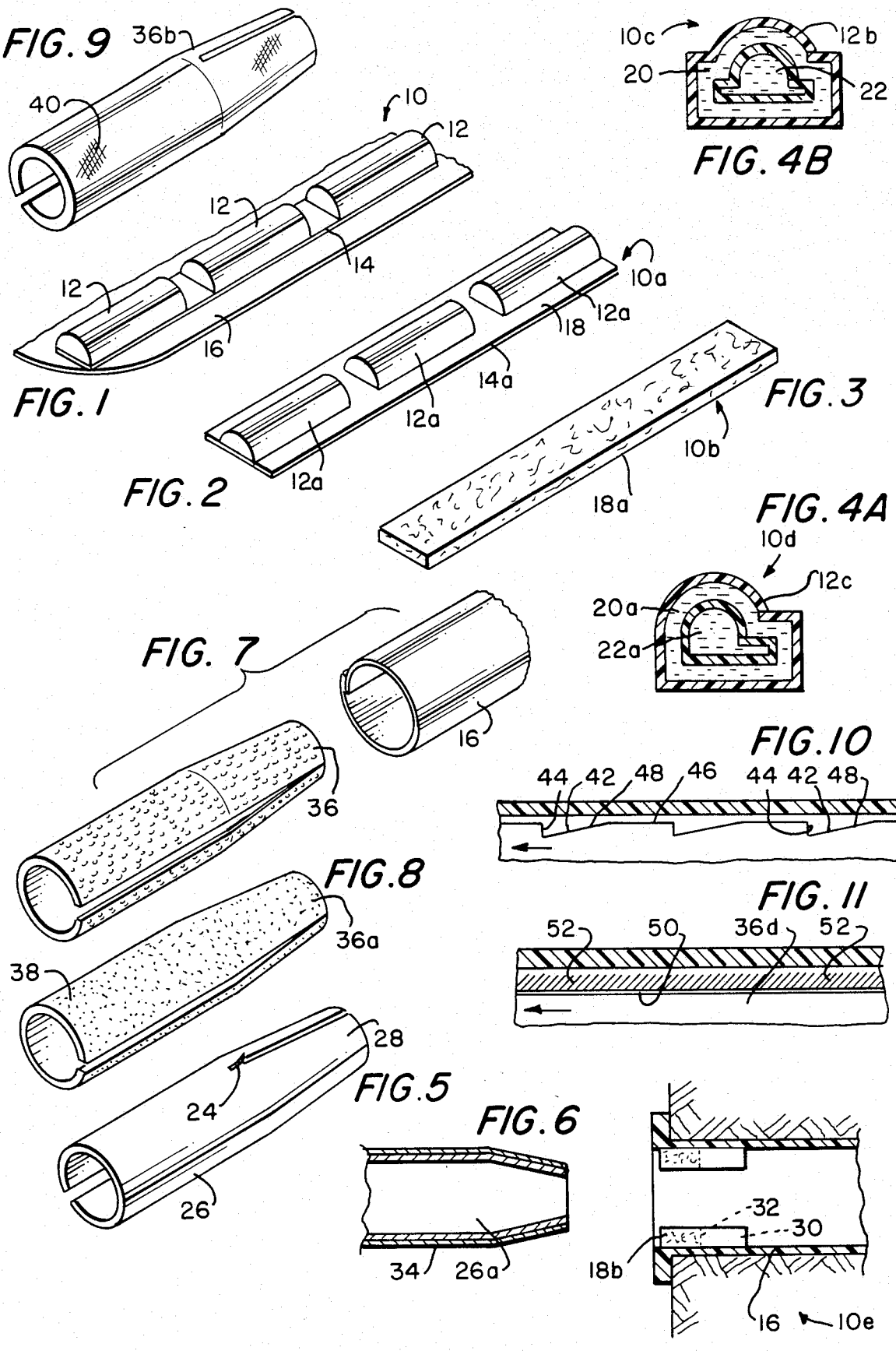
FIG. 1 is an isometric projection of a portion of an inner surface of a plastic sheath, for a friction rock stabilizer, to which has been glued a plurality of impervious, adhesive-containing capsules.
FIG. 2 is a projection like FIG. 1 (less the sheath portion), showing a plurality of capsules fixed to wicking.
FIG. 3 is a perspective view of an adhesive-containing wicking.
FIGS. 4A and 4B are isometric projections of two-compartment capsules for two-component adhesives.
FIG. 5 is a perspective view of a friction rock stabilizer having a capsule cutter projecting therefrom.
FIG. 6 is an elevational view, in cross-section, of a stabilizer and bore-confined sleeve.
FIG. 7 is a perspective view of a grit-blasted stabilizer.
FIG. 8 is a perspective view of a frit-coated stabilizer.
FIG. 9 is a perspective view of a stabilizer with a knurled surface.
FIG. 10 is a fragmentary view, in cross-section, of a stabilizer formed with one-way recesses in the surface thereof.
FIG. 11 is a fragmentary view, in cross-section, of a stabilizer with a filament-bearing coating thereon.

First embodiments of the invention comprise the use of adhesive systems to bond the friction rock stabilizer and its sheath together. Now, to be convenient for underground operations, an adhesive system must be factory-installed and the parts brought together some several months later at the mine site where the stabilizer boreholes are located. My invention provides a means of applying the adhesive in the factory and retaining it in position during shipping and handling as well as providing for spreading (and mixing) of the adhesive during stabilizer insertion.

The basic concept of the novel adhesive system is to retain the adhesive in a position on the plastic sleeve or sheath (or alternatively on the metal stabilizer) in a containing system so that it is in the proper position at the time of insertion of the stabilizer into the earth bore. Insertion spreads (and mixes, if necessary) the adhesive by: (1) forcing rupture of the containers, (2) squeezing adhesive out of a wicking type retainer, or (3) cutting the containers with a specially designed cutting edge on the stabilizer.

The containing system must be compatible with the storage requirements for the particular adhesives to be used. For instance, solvent-type adhesives must be in impervious containment, anaerobic adhesives must have access to oxygen, and two-component systems must be kept separated. Also, two-component systems require some degree of mixing during activation of the adhesive.

FIG. 1 shows an impervious capsule system 10 suitable for retaining one-component adhesives. The capsules 12, for example, are made of a thin plastic film which is heat sealed. The capsules 12 are of short length but are shown as a continuous tape 14 which is glued to the plastic sheath 16. The system 10 is activated by the pressure of the inserted stabilizer which bursts the capsules. If an anaerobic is stored in the capsule, the later is partially filled with air, and is made of a material, such as polyethelene, which breathes oxygen to assist in preventing premature cure.

FIG. 2 shows a similar capsule system 10*a* which employs a wicking type material 18 made into a continuous tape 14*a* which is glued to the plastic sheath (not shown). This system is tailored for single-component anaerobic-type adhesives and the capsules 12*a* are partially filled with air as well as being made of polyethelene to have access to oxygen. The system 10*a* is activated by the pressure of the inserted stabilizer which bursts the capsules. The glue bond of the stabilizer and sheath is made through the wicking material 18 as well as beyond it with excess adhesive.

FIG. 3 is another system 10*b* configured for single-component anaerobic-type adhesives. It consists of a wicking material 18*a* comprising a thick porous paper. Open cell, sponge or other cloth-type materials, for example, could also be used. This is made into a tape-configuration and glued to the plastic sheath. The wicking material 18*a* is capable of absorbing more adhesive than it can retain under the pressure of stabilizer insertion. When the stabilizer is inserted it squeezes adhesive out of the wicking material which bonds the stabilizer to the plastic sheath. The two are also bonded through the wick material. This system also requires that the sheath be maintained as a closed container until ruptured during insertion of the stabilizer to prevent loss of the adhesive monomer.

FIG. 4*a* shows an impervious capsule system 10*d* similar to that of FIG. 1 but with two compartments 20 and 22 in each capsule 12*b* so that it handles a two-component adhesive. FIG. 4*b* shows an alternative construction. The capsules 12*c* are made up in a continuous tape system 10*c* which is glued to the plastic sheath. The construction is made of thin plastic film which is heat sealed. The system is activated by the pressure of the inserted stabilizer. This causes both compartments 20*a* and 22*a* (and 20 and 22) of the capsules 12*c* (and 12*b*) to burst. This, together with the sweeping motion of inserting the stabilizer both mixes and spreads the adhesive.

FIG. 5 shows an alternate means of opening the capsules 12 . . . 12*c*. A specially-shaped cutting edge 24 is formed on the stabilizer 26 at the end of the taper 28 thereof. The cutting edge 24 is radially oriented and is configured so that it cuts the capsules 12 . . . 12*c* open but does not cut into the plastic sheath. In this manner, the adhesive is exposed and spread during insertion of the stabilizer 26.

FIG. 6 depicts an alternative adhesive system 10*e* which also allows it to be factory-installed and the parts brought together some several months later in the mine. This concept consists of applying a solvent-activated adhesive to the surface of the stabilizer and sheath (if desired) in the factory, and letting it cure fully. The adhesive is then reactivated by solvent, at the mine, so that the parts can be slid together; the solvent quickly migrates into the cured adhesive and a bond is achieved. My invention comprises a means of achieving this reactivation of the adhesive using a device that avoids handling the solvent in the mine and permitting preparation of all components in the factory.

The concept, as shown in FIG. 6, consists of an anular reservoir 30 filled with solvent and glued to the plastic sheath 16, and a wick 18*b* glued below the reservoir 30. A weakened diaphragm 32 exists in the reservoir 30 on the face that attaches to the wick such that, when pressure is applied, the reservoir ruptures and fills the wick. The wick than acts as a wiper to reactive adhesive 34 which has been applied to the outside surface of the stabilizer 26*a*. The reservoir 30 is made of a thin plastic material and the wick 18*b* of cotton (although other suitable wicking could be used).

FIGS. 7 through 9 depict alternative practices of the invention which provide mechanical means of enhancing the grip or anchorage of the stabilizer in the borehole, after insertion, by bonding thereof to the plastic sheath.

The basic approach is to take advantage of the facts that: (1) plastic will flow under pressure loading, and (2) there is a time delay in the effect. When a plastic sheet is pressed against a rough surface, the plastic will be deformed or dispersed and will be extruded from prominences and flow into the crevices in the rough surface. This will greatly enhance the friction coefficient between the surfaces by providing a mechanical interlock. During testing of my instant invention another bonding mechanism, arising from the practice of my disclosure, came to light. The same pertains to the fusing of the sheath 16 to the stabilizer 26 due to the heat of friction.

Inserting the stabilizer 26 into the plastic sheath 16, in rock, requires a considerable force. This force is applied through a given distance, typically 5 or 6 feet (i.e., the common length of a stabilizer). A force moved through a distance equates to work done. For example, if the force averages 3,500 lbs. times a distance of 5 feet, 17,500 ft-lbs of work will have been done. If this is done in 5 seconds (a typical installation time for a five-foot friction rock stabilizer), power is being expended at a rate of 6.4 HP or 4.7 KW. This power results in heat at the area of friction; i.e., at the interface of the sheath 16 and stabilizer 26. Since the heat cannot be dissipated fast enough, the temperature at this interface rises and the immediate surface of the plastic sheath 16 melts. (This probably results in some reduction in friction thereby easing insertion loads). When insertion of the stabilizer 26 has been completed, the heat rapidly dissipates and the plastic surface of the sheath 16 solidifies again, but now it accomplishes a heat bond or fusing to the stabilizer 26. The net effect is an eased insertion and much higher loads to cause slip after insertion; i.e., easy in, hard out. In the test program, it was demonstrated that a common roof bolter, capable of exerting no more than 5,000 to 6,000 lbs. of thrust was able to insert stabilizers (such as stabilizer 26) into plastic sheaths in boreholes (without impact) that required up to 17,000 lbs. of pull-out force to cause slippage of the stabilizer after insertion. This is deemed to establish that the frictionally-induced fusing, and extrusion and flow of the plastic sheath, from prominences and into reliefs in the wall of the bore and the surface of the stabilizer, cause the anchorage force to be thrice the insertion force.

FIG. 7 shows a roughened-surfaced stabilizer 36 which is to be inserted, with a high interference fit, into a plastic sheath 16 previously inserted in an earth borehole (not shown). Any means could be used to roughen the surface, such as grit blasting. Since a low-friction plastic (polyethylene) sheath 16 is used, the insertion loads are modest. However, the high compressive pressure on the plastic causes it to flow with time into the roughness in the surface of the stabilizer. Too, the heat of friction, occurring during stabilizer insertion, together with the aforesaid pressure, causes the plastic to fuse onto the stabilizer and the wall of the borehole. This greatly enhances the friction coefficient, and provides an adequate bond between the stabilizer 36 and sheath 16.

FIG. 8 shows a similar concept in which the stabilizer 36*a* is coated with a powder plastics (frit) coating 38. This coating is applied in the factory where heat, good adhesives, cleanliness, etc. can affect a good bond. The coating can be made impervious to the passage or attack of mine waters. The stabilizer 36*a* is then inserted into the previously inserted plastic sheath, with a high interference fit. As low friction plastic (polyethelene) is used, the insertion loads should be modest, and the frit coating is not scraped off. After insertion of the stabilizer 36*a*, the high compressive pressure on, and the residual heat of friction, generated during stabilizer insertion, obtaining in the plastic forces a fusion of the plastic (polyethylene) surfaces and a flow into the surface roughness of the stabilizer 36*a*. Thus grip is enhanced by both mechanical interlock and an intermolecular fusion effect.

The mechanical bonding practice of my invention can also be carried out by simply forming a knurled surface 40 on the stabilizer 36*b*, as shown in FIG. 9. Additionally, the surfacing of the stabilizers can be directionally-oriented to facilitate insertion thereof into the sheaths, and to inhibit withdrawal. FIGS. 10 and 11 illustrate embodiments thereof. The stabilizer 36*c* in FIG. 10 has a plurality of recesses 42 formed therein. Each of the recesses has a wall 44, which lies substantially normal to the exterior surface 46 of the stabilizer, and an inclined surface 48. The surfaces 48 rise and blend in, smoothly, with the surface 46 of the stabilizer. Hence, the recesses 42 define something akin to sawteeth which are ineffective in the insertion direction (shown by the arrow), but are mechanically effective in the opposite direction. The inner surface of the plastic sheath 16 insinuates itself into the recesses 42 and "flows" onto the surfaces thereof to lock the sheath 16 and stabilizer 36*c* together.

The stabilizer 36*d*, in FIG. 11, has an epoxy coating 50 which beds ends of a great multiplicity of filaments 52. The filaments 52 are short metal strands, and the pendant ends thereof and lie at an acute angle relative to the exterior surface of stabilizer 36*d*. Again, in the insertion/arrow direction of travel, the filaments 52 simply brush along the sheath 16. In the opposite direction of travel they penetrate into the sheath and lock the latter and stabilizer 36*d* together.

While I have described my invention in connection with specific embodiments thereof, it is to be clearly understood that this is done only by way of example, and not as a limitation to the scope of my invention as set forth in the objects thereof and in the appended claims.

I claim:

1. In combination, an earth stabilizer, for stabilizing an earth structure, and sheathing means therefor, wherein:

said stabilizer comprises an elongate element for resisting movement of an earth structure from within a bore, having a corrosive environment, formed in the earth structure to receive said element therewithin;

said sheathing means comprises means (a) conformed for sheathing fully thereabout an exterior surface and a given length of said element, and (b) for admitting said element thereinto;

said sheathing means and said element together further comprise means cooperative, following both (a) reception of said element within such a bore, and (b) admittance of said element into, and sheathing thereof by said sheathing menas, for (1) exerting a radial force against the surface of such bore, and (2) completely isolating such fully sheathed exterior surface, of said given length of said element, from the surface of such bore and sheathing said exterior surface from the corrosive environment of such bore;

said sheathing means further comprises an inner surface for forming an interface thereof with said exterior surface of said element, and an outer surface for forming an interface thereof with said surface of such bore;

said sheathing means is formed of deformable material; and said exterior surface of said element has means, responsive to an admittance of said element into said sheathing means, within an earth structure bore, for deforming at least one of said inner and outer surfaces of said sheathing means, and for effecting a locking engagement of at least one of said inner and outer surfaces with an interfacing one of said bore and element surfaces.

2. The combination, according to claim 1, wherein:

said deforming and locking means comprises means for intruding into said one surface of said inner and outer surfaces.

3. The combination, according to claim 1, wherein:

said deforming and locking means comprises means for dispersing at least some of said deformable material of said one surface of said inner and outer surfaces.

4. The combination, according to claim 1 wherein:

said sheathing means comprises a sheath formed of an inert, corrosion-resistant material, which (a) is responsive to heat of friction and pressure to cause said material to fuse onto an object against which it is pressed, and (b) extrudes from and flows into prominences and crevices in surfaces with which it is forceably interfaced.

5. The combination, according to claim 1, wherein:

said deformable material comprises means which, responsive to relative movement between said element and said sheathing means, heats and fuses onto said exterior surface of said element.

6. A combination, according to claim 1, wherein:

said deforming and locking means comprises a coarse or non-smooth finish formed on said exterior surface of said element.

7. A combination, according to claim 1, wherein:

said deforming and locking means comprises a knurled finish formed on said exterior surface of said element.

8. A combination, according to claim 1, wherein:
said deforming and locking means comprises a coating of granular material on said exterior surface of said element.

9. A combination, according to claim 1, wherein:
said deforming and locking means comprises a plurality of recesses formed in said exterior surface of said element;
said recesses each having a wall at one end which lies substantially normal to said exterior surface and a recessed surface which inclines from said wall to substantially smoothly blend into said exterior surface at the opposite end.

10. A combination, according to claim 1, wherein:
said deforming and locking means comprises a coating on said exterior surface of said element, said coating having fixed therein a multiplicity of filaments; and
said filaments project outwardly from said coating and are generally oriented at an acute angle relative to said exterior surface.

11. A method of securing an elongate earth stabilizer in a bore, having a corrosive environment, formed in an earth structure to receive such stabilizer therewithin, comprising the steps of:
providing deformable material;
conforming said material into a configuration, defining inner and outer surfaces thereof, for sheathing fully thereabout an exterior surface and a given length of an elongate earth stabilizer;
disposing the so-conformed and configured material in an earth structure bore, with the outer surface confined by, and defining an interface with, the surface of the bore; and
inserting an elongate earth stabilizer into said material, in the bore, for sheathing by said material of an exterior surface and given length of the stabilizer; further including
treating the exterior surface of the stabilizer, prior to inserting the latter into said material, to cause such exterior surface to deform said material, and to come into locking engagement with said material, as a consequence of (a) stabilizer insertion thereinto, (b) confinement of said material by said surface of the bore, and (c) such exterior surface treatment; wherein
said material-providing and material-conforming steps comprise providing a sufficiency of said material, and conforming the same into such a configuration that following insertion of the stabilizer into said material within the bore, said material, as aforesaid, sheaths fully about said given-length, exterior surface of said stabilizer, isolates said given-length, exterior surface from the surface of the bore, and sheathes said exterior surface from the corrosive environment of the bore.

12. A method, according to claim 11, wherein:
said disposing step comprises inserting into the bore a lining of said material which (a) is corrosive-resistant material, (b) is responsive to heat of friction and pressure to cause said material to fuse onto an object against which it is pressed, and (c) extrudes from and flows into prominences and crevices in surfaces with which it is forceably interfaced.

13. A method, according to claim 11, wherein:
said stabilizer-inserting step comprises forceably and movably engaging the inner surface of the material with the exterior surface of the stabilizer and, as a consequence thereof, frictionally heating, thereby, said inner surface, and pressing the outer surface of the material forceably into an interface with the surface of the bore.

14. A method, according to claim 11, wherein:
said surface-treating step comprises forming a coarse or non-smooth finish on said exterior surface of the stabilizer.

15. A method, according to claim 11, wherein:
said surface-treating step comprises forming a knurled finish on said exterior surface of the stabilizer.

16. A method, according to claim 11, wherein:
said surface-treating step comprises forming a coating of granular material on said exterior surface of the stabilizer.

17. A method, according to claim 11, wherein:
said surface-treating step comprises forming a plurality of recesses in said exterior surface of the stabilizer.

18. A method, according to claim 17, further including:
forming each of said recesses with a wall at one end thereof which lies substantially normal to said exterior surface of the stabilizer, and with a recessed surface which inclines from said wall and substantially smoothly blends into said exterior surface at the opposite end.

19. A method, according to claim 11, wherein:
said surface-treating step comprises forming a coating on said exterior surface of the stabilizer, which coating has a multiplicity of filaments fixed therein; and
arranging said filaments to project outwardly from said coating and to lie at an acute angle relative to said exterior surface.

* * * * *